United States Patent [19]

Buttram et al.

[11] Patent Number: 4,888,556

[45] Date of Patent: Dec. 19, 1989

[54] LINEAR INDUCTION ACCELERATOR AND PULSE FORMING NETWORKS THEREFOR

[75] Inventors: Malcolm T. Buttram, Sandia Park; Jerry W. Ginn, Albuquerque, both of N. Mex.

[73] Assignee: The United States of America as represented by the United States Department of Energy, Washington, D.C.

[21] Appl. No.: 209,398

[22] Filed: Jun. 21, 1988

[51] Int. Cl.[4] ..... H05H 9/00

[52] U.S. Cl. ..... 328/233

[58] Field of Search ..... 328/233; 315/5.41

[56] References Cited

U.S. PATENT DOCUMENTS

| | | | |
|---|---|---|---|
| 2,976,444 | 3/1961 | Kerst et al. | 313/62 |
| 3,171,030 | 2/1965 | Foster et al. | 250/95 |
| 3,479,532 | 11/1969 | Kennedy | 307/260 |
| 4,196,359 | 4/1980 | North et al. | 307/268 |
| 4,646,027 | 2/1987 | Birx et al. | 328/233 |
| 4,684,820 | 8/1987 | Valencia | 307/106 |
| 4,695,733 | 9/1987 | Pesavento | 250/551 |
| 4,730,166 | 3/1988 | Birx et al. | 328/233 |

OTHER PUBLICATIONS

"The Era 4 MeV Injector" by R. Avery et al., 1971, Particle Accelerator Conference, Accelerator Engineering and Technology, Chicago, Ill., U.S.A., (1-3 Mar. 1971), pp. 479-483.

"Linear Induction Accelerators Made From Pulse--Line Cavities with External Pulse Injection," by Ian Smith, Rev. Sci. Instrum., 50(6), Jun. 1979, pp. 714-718.

R. Hester et al., "The Experimental Test Accelerator (ETA)", *IEEE Transactions on Nuclear Science,* vol. NS-26, No. 3, Jun. 1979, pp. 4180-4182.

L. Reginato, "The Advanced Test Accelerator (ATA), A 50-MeV, 10-kA Induction LINAC" *IEEE Transactions on Nuclear Science,* vol. NS-30, No. 4, Aug. 1983, pp. 2970-2974.

R. Stinnett et al., "The Pt1 Linear Induction Accelerator", *6th IEEE Pulsed Power Conference,* Arlington, Va, 06/29/87-07/01/87.

F. Zutavern et al., "Recent Development in Opening Photoconductive Semiconductor Switches", *6th IEEE Pulsed Power Conference,* Arlington, Va, 06/29/87-07/01/87.

F. Zutavern et al., "Engineering Limits of Photoconductive Semiconductors Switches in Pulsed Power Applications", *IEEE Conference Record of the 17th Power Modulator Symposium,* Jun. 1986, Seattle, Wa.

*Primary Examiner*—Palmer C. DeMeo

*Attorney, Agent, or Firm*—George H. Libman; James H. Chafin; Judson R. Hightower

[57] ABSTRACT

A linear induction accelerator includes a plurality of adder cavities arranged in a series and provided in a structure which is evacuated so that a vacuum inductance is provided between each adder cavity and the structure. An energy storage system for the adder cavities includes a pulsed current source and a respective plurality of bipolar converting networks connected thereto. The bipolar high-voltage, high-repetition-rate square pulse train sets and resets the cavities.

10 Claims, 3 Drawing Sheets

LINEAR INDUCTION ACCELERATOR AND PULSE FORMING NETWORKS THEREFOR

The Government has rights in this invention pursuant to Contract No. DE-AC04-76DP00789 between the U.S. Department of Energy and AT&T Technologies, Inc.

FIELD OF THE INVENTION

This invention relates generally to a linear induction accelerator, and more particularly to a light weight, compact, linear induction accelerator which produces long bursts of short, closely-spaced, relatively high current electron beam pulses.

BACKGROUND OF THE INVENTION

A linear induction accelerator is used to generate repetitively pulsed, multimegavolt, multikiloampere electron beams. Such devices are disclosed in the following: U.S. Pat. No. 2,976,444 (Kerst et al); "The Experimental Test Accelerator (ETA)", R. E. Hester et al, *IEEE Transactions on Nuclear Science,* Volume NS-26, No. 3, June 1979, page 4180; and "The Advanced Test Accelerator, A 50-MeV, 10-kA Induction Linac", L. Reginato, *IEEE Transactions on Nuclear Science,* Volume NS-30, No. 4, August 1983, page 2970.

In such a device, the accelerator includes two stages. In the first stage, high voltage pulses (typically 100–500 kV, 50–100 ns) are produced from external, water-insulated pulse forming lines. These pulses are then injected into ferrite isolated adder cavities. The effect of the cavities is to add the voltages from a large number of such cavities to produce a beam having a voltage equal to the output of the pulse forming lines times the number of cavities and a current equal to the output of the pulse forming lines.

Unfortunately, such a linear induction accelerator is too large and heavy for aerospace applications. Its irreducible weight comes primarily from the ferrite isolators and from the water dielectric in the pulse forming lines. In such a conventional accelerator, the ferrite isolators are inserted to prevent rapid shorting of the pulse forming lines output to ground. There is an inevitable inductive short to ground in such devices, but the ferrite makes the pulse impedance of the short large enough to have no substantial effect on 50–100 ns pulses.

In U.S. Pat. No. 3,171,030 (Foster et al), a "gatling gun pulse train generator" is described in which a series of pulse forming networks are charged simultaneously and discharged sequentially through a step-up transformer to produce a high voltage pulse train. Short bursts of pulses of one polarity are created. However, for a high-energy, lightweight, linear induction accelerator, a longer burst is necessary as well as a bipolar pulse. In U.S. Pat. No. 3,479,532 (Kennedy) a similar concept is disclosed, except for the use of saturable magnetic switches as opposed to vacuum/plasma switches. Still another similar apparatus is disclosed in U.S. Pat. No. 4,196,359 (North et al). In this patent, only one long pulse is generated as opposed to a pulse train.

A symmetrically charged pulse-forming circuit is disclosed in U.S. Pat. No. 4,684,820 (Valencia). This patent describes a scheme for charging a Blumlein pulse circuit in such a way that the load, such as a laser, is not disturbed by the charging process. The charging circuit produces a relatively high-voltage, fast rise time pulse and includes pulse forming networks.

A photoconductive power switch capable of producing electrical pulses of at least 10 ampere and 100 volts is disclosed in U.S. Pat. No. 4,695,733 (Pesavento). Switching speeds of one nanosecond or less can be provided. However, the ratings of such a switch are a factor of 100 to 1000 below the voltage and current requirements of a linear induction accelerator. In addition, because the switch does not open as rapidly as it closes, it would not be suitable for use in this linear induction accelerator.

SUMMARY OF THE INVENTION

It is an object of the invention to provide a lightweight linear induction accelerator.

It is a further object of the invention to provide a linear induction accelerator that uses bipolar pulses to alternately accelerate an electron beam and to reset a cavity.

It is another object of the invention to provide a linear induction accelerator that does not require ferrite cores in its cavities.

Additional objects, advantages, and novel features of the invention will become apparent to those skilled in the art upon examination of the following description or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the present invention may comprise a linear induction accelerator of an electron beam comprising a pulsed current source including a constant current source and a switch for alternately switching the output of the current source between either first or second terminals. At least one bipolar converting circuit is connected between the first terminal and ground for converting the pulsed current at the first terminal into a bipolar high-voltage, square wave pulse train having a pulse of a first polarity when the output is connected to said second terminal, and a pulse of a second, opposite, polarity when the output is connected to said first terminal. A matching impedance is connected to the second terminal, the impedance at each of the first and second terminals being equal. At least one cavity is connected between the first terminal and ground for accelerating the electron beam during the pulse of a first polarity and for resetting the cavity during the pulse of a second polarity.

DETAILED DESCRIPTION OF THE INVENTION

Figure 1:
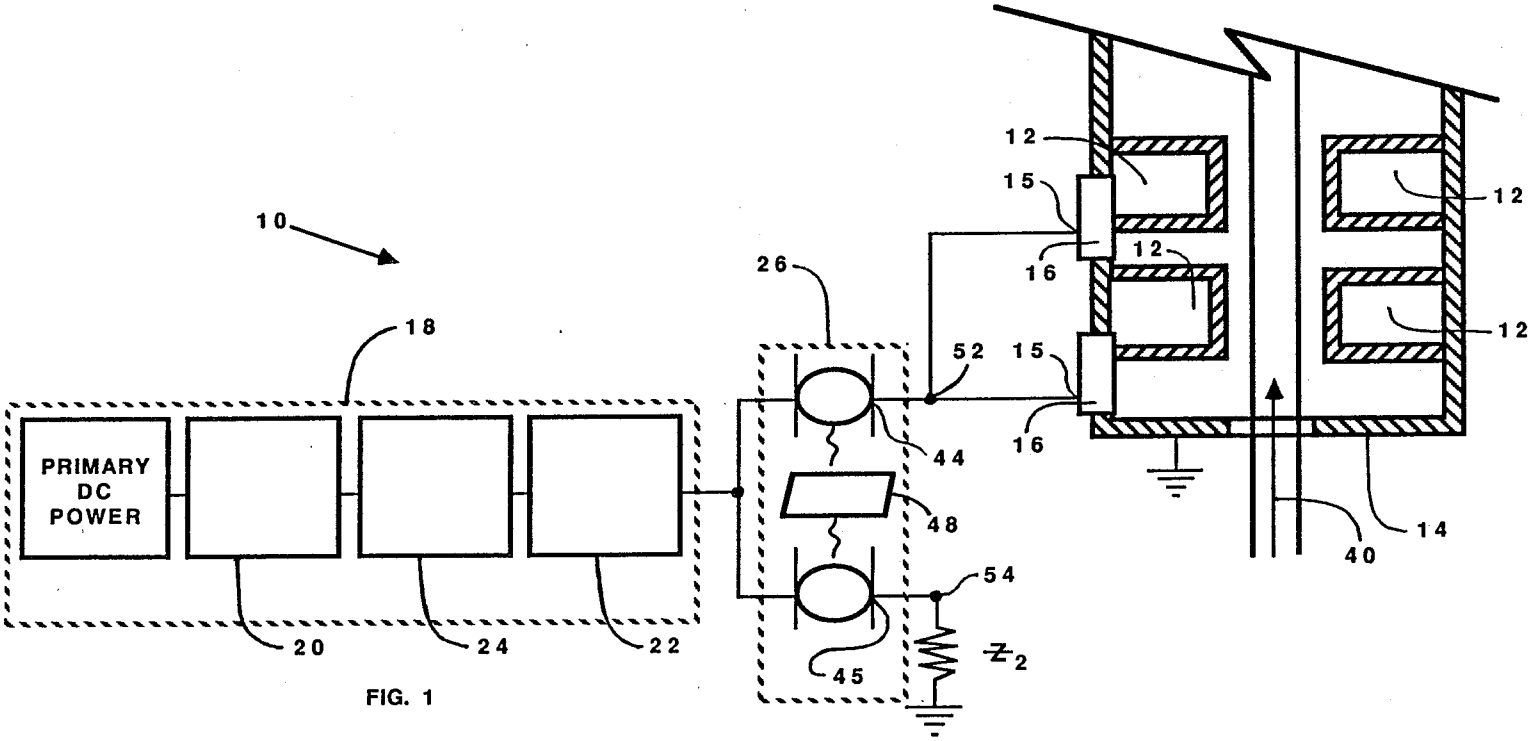
FIG. 1 is a block diagram of a module of a linear induction accelerator according to the present invention.
Figure 2:
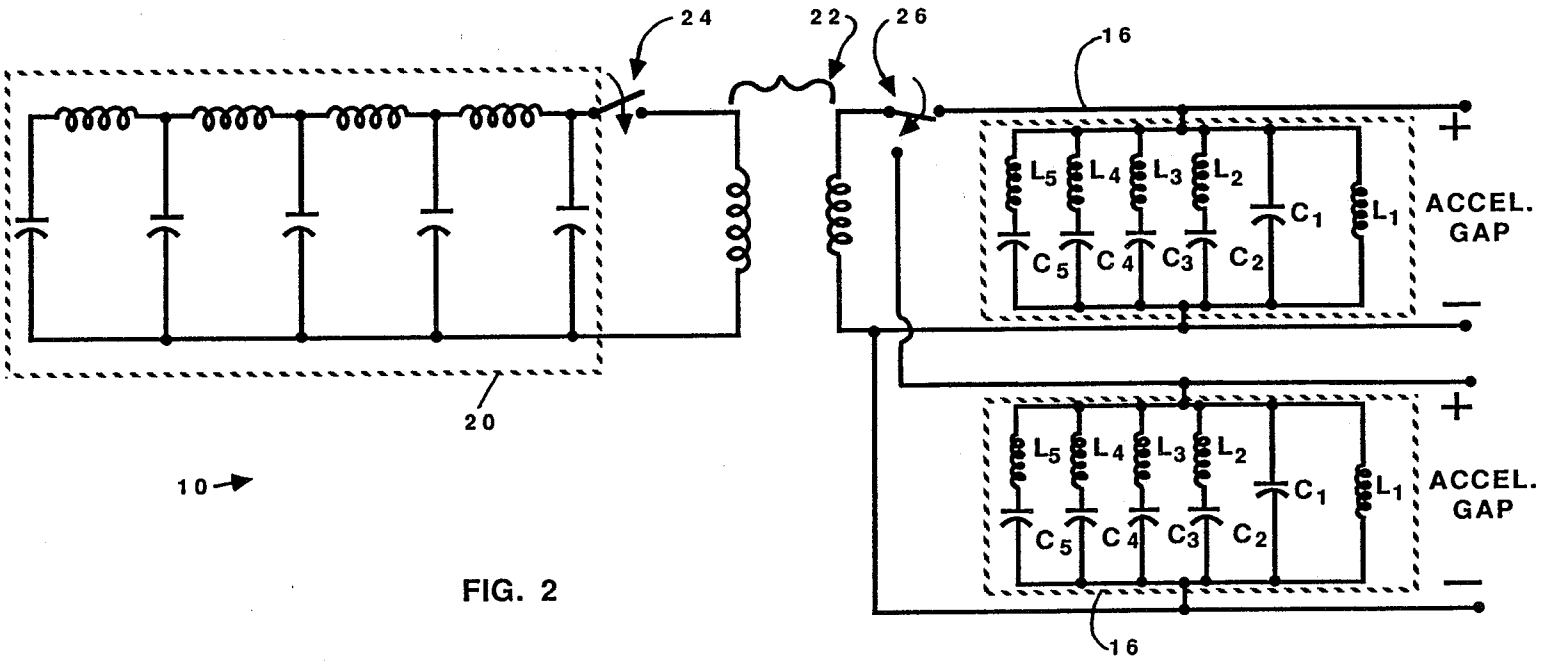
FIG. 2 is a schematic circuit diagram of the module depicted in FIG. 1.

In the embodiment of a linear induction accelerator 10 depicted in FIG. 1, a plurality of toroidal linear induction accelerator adder cavities 12 are contained within a grounded outer vacuum structure 14. The cavities provide an inductance between their high voltage input 15 and ground. This inductance $L_1$ is then used as part of the pulse shaping system of linear induction accelerator 10, as discussed hereinafter. An electron beam 40 passes through cavities 12. When a positive pulse is applied to electrical input 15 of each cavity, a magnetic field is produced in each cavity 12 that induces a voltage on the cavity, accelerating beam 40 as is well known to those skilled in this art.

The pulse-forming line water capacitor in a conventional linear induction accelerator is eliminated with this present invention, which has a power source for cavities 12 including a constant current source 18 having a relatively long time-duration output (e.g. several microseconds) feeding single-pole, double-throw, switch 26.

The energy required for a multi-microsecond pulse train is stored in low-voltage, energy-storage pulse-forming network 20. At these voltage levels, a few tens of kilovolts, commercial capacitor technology permits energy storage at densities which are considerably higher than those obtainable at hundreds of kilovolts. Thus, the mass of the portion of linear induction accelerator 10 which is associated with energy storage is greatly reduced from prior art devices. The output of pulse-forming network 20 is switched into the primary of step-up transformer 22 through a closing switch 24 such as a thyratron or spark gap. The output of transformer 22 is connected through switch 26 to a bipolar converting circuit 16 and cavity 12, as discussed hereinafter.

Single-pole double-throw switch 26 has first output terminal 52 and second output terminal 54. A preferred embodiment of switch 26 consists of a first switch 44 connected to terminal 52 and a second switch 46 connected to terminal 54. Switches 44, 46 are operated such that switch 46 is open while switch 44 is closed, and visa versa. Preferably, switches 44, 46 may comprise photoconductive semiconductor switches activated by laser 48. In the photoconductive semiconductor switch, charge carriers are produced by photons incident on the switch material. Intrinsic material properties and doping levels determine the charge carrier lifetimes in the switch. A laser is used to provide a well-defined light pulse to allow the switch to conduct current. When the light pulse ends, the switch opens on a time scale characteristic of the charge carrier lifetime. Opening and closing times of less than 10 ns are obtainable with either GaAs or gold-doped silicon material. The photoconductive semiconductor switch is expected to operate at a voltage of 250 kV and a current of 5 kA, with very low jitter. Because the switch opening and closing times are controlled by a well-defined laser pulse, the accelerator cavities in all modules can be operated with the correct phasing to accelerate an electron beam effectively. (See F. Zatavern et al., "Engineering Limits of Photoconductive Semiconductor Switches in Pulsed Power Applications", *IEEE Conf. Record of the 17th Power Modulator Symposium*, Seattle, Wash., 1986, pp. 214–218, for more information on these fast-acting, high voltage, switches.)

Because of the leakage inductance of transformer 22, it is important that constant current source 18 always see a constant output impedance to prevent spurious voltage spikes. The load impedance at first terminal 52 is equal to the parallel impedances of the all the cavities 12 and the bipolar converting circuits 16. Accordingly, second terminal 54 is connected to an impedance $Z_2$ equal to the impedance at first terminal 52. In practice, second terminal 54 may be connected to an identical set of cavities and bipolar networks as is first terminal 52. The result of this arrangement is that transformer 22 always sees a constant impedance, regardless of which switch pole is activated. Furthermore, the bipolar network alternately sees a voltage across an impedance, and an open circuit, as necessary for the operation of the device.

Figure 4A:
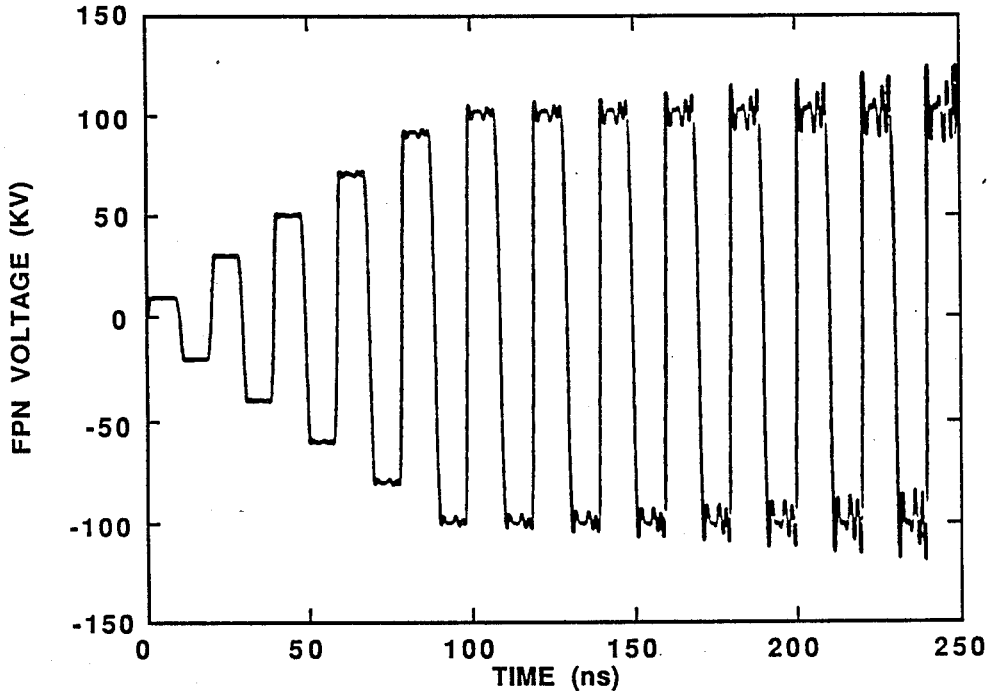
FIG. 4A and 4B are two graphical representations of the load voltage for the circuit depicted in FIG. 3.

The conventional linear induction accelerator includes a ferrite core in cavity 12 to electromagnetically couple energy into a beam inside a closed structure. This technique permits the closed structure and the neutral of all feed lines to remain at ground potential, thus alleviating the high-voltage insulation problem that would otherwise result from stacking of several feed lines. The presence of a ferrite limits the pulse duration of the system, because of ferrite's recognized property of saturating in the presence of a high or sustained magnetic field. A saturated ferrite becomes a low inductance to ground and must be reset by applying an opposite magnetic field before it will function with a subsequent pulse. In accordance with this invention, cavities 12 are reset by applying a bipolar pulse train of alternating positive and negative pulses, as shown in FIG. 4A. This bipolar pulse train is created from the pulsed output at first terminal 52 by bipolar converting network 16.

A preferred embodiment of bipolar converting network 16 is a Guillemin type A current-fed pulse-forming network. In such a network, the inductance L1 of cavity 12, with or without ferrite, can be the principal pulse-forming network inductance, together with capacitors C1, C2, C3, C4, and C5 and inductors L2, L3, L4, and L5. As shown in FIG. 1, a coaxial representation of network 16 may be attached to input 15 of cavity 12. In linear induction accelerator 10, the total duration of the electron-beam pulse, which is limited by the ferrite size and voltage in a conventional linear induction accelerator, is now limited by values of L1 that can be achieved by using the geometry of a vacuum cavity structure as a lumped inductance.

The type A, current-fed, Guillemin network is one of a number of mathematically equivalent circuit implementations which are analogous in function to a pulse-forming transmission line shorted at one end. The five-section implementation shown (a network comprised of five capacitors and five conductors) is designed to produce a trapezoidal pulse with a rise time that is eight percent of the pulse duration. Other implementations with fewer elements are possible with some corresponding decrease in pulse quality.

An integral component of such current-fed pulse-forming networks is a shunt inductance (in this case, vacuum inductance L1 of cavity 12) which represents a short-circuit across the input for long time durations. Therefore, the current to bipolar network 16 rises toward a value determined by transformer 22 and the charge voltage of low-voltage pulse-forming network 20 with its characteristic impedance. This build-up is exponential with an e-folding time of $L_t/Z_n$, where $L_t$ is the leakage inductance of transformer 22 and $Z_n$ is the impedance of low-voltage pulse-forming network 20. In this regard, it should be noted that both impedances and L1 must be referenced to the same side of transformer 22.

Figure 3:
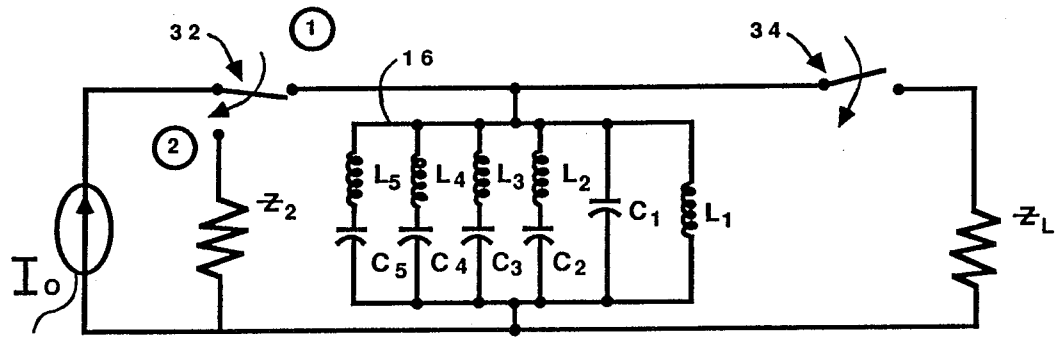
FIG. 3 is a schematic circuit diagram of an alternative module.

Because of the action of the inductor to preserve constant current as a function of time, the combination of low-voltage pulse-forming network 20 and transformer leakage inductance approximates a current source, as shown in FIG. 3, where the low-voltage charging circuit and transformer 22 have been replaced by a current source 30 which drives bipolar network 16 through a high-repetition-rate, fast-opening-and-closing, single-pole, double-throw switch 26. When switch 26 is thrown to position 2, the current from current source 30 is diverted into another bipolar network located at another accelerator module or into some other suitable impedance which permits the current to remain constant. For example, this impedance can be impedance Z2, set equal to the impedance of network 16 in the simulations that follow. If no load $Z_L$ is applied, that is if switch 34 remains open and switch 26 is toggled at time intervals equivalent to the pulse duration of the pulse-forming network, the voltage across the pulse-forming network can be increased to values that are limited only by the ability of the actual driving circuit current source to supply energy.

For the simplified case illustrated in FIG. 3, the voltage build-up sequence is as follows. In common with all pulse-forming networks, the Guillemin current-fed pulse-forming network is a mathematical approximation to a transmission line. The behavior of the pulse-forming network is therefore described in terms of its transmission line analog in which the transmission line is shorted on the end opposite the source end load. In the following analysis, it should be understood that the values of the network 16 are selected so that the equivalent transmission time down the length of transmission line is equal to $\tau$, the period at which switch 26 operates.

The open-circuit pulse-forming network voltage build-up sequence is as follows. For the first half-cycle, the voltage across the pulse-forming network is equal to the current source times the pulse-forming network impedance. The current wave induces a voltage wave equal in magnitude to the current times the line impedance ($I_o$ times $Z_o$, defined as $V_o$), travelling toward the shorted end. A wave travelling in this direction is defined as a forward going wave. When this wave reaches the short, it reflects, generating a reverse or reflected wave. The forward and reflected waves begin to overlap generating a region where the resultant voltage is zero and the resultant current equals twice the injected current. This region fills the line a double transit time after the beginning of injection.

In terms of the lumped-element pulse-forming network, the current through pulse-forming network inductance element L1 increases linearly during the first pulse duration to a value equal to twice that of the input current source. This current doubling is analogous to the doubling of current that occurs in the short-circuited transmission line. By the nature of the oscillatory branches of the pulse-forming network, at the end of one pulse duration ($\tau$), the overall network voltage collapses and begins to reverse. This is analogous to what happens in the transmission line when the arrival of the reflected wave at the source end of the line initiates the second half-cycle. A half cycle in this case lasts for one pulse-forming network pulse duration time, which is equivalent to a two-way transit time in the transmission line analog.

During the second half-cycle, the pulse-forming network is disconnected from the driving current source. In terms of the transmission line, the current reverse wave from the short circuit at this time is inverted and reflected back in the forward direction by the infinite impedance of the open circuit. At the same time, ($t=2\tau$), the current wave which was injected at $t=0$ is interrupted by the opening of the switch. The net result is that no current is flowing on the source end of the line. In the wake of the new forward relief wave, the line has no current flowing and is charged to a voltage of $-2V_o$. The voltage at the source end (the pulse-forming network voltage) therefore reverses and doubles at $t=2\tau$.

At the beginning of the second cycle, switch 26 closes, reconnecting the current source, adding a wave which reinforces that of the reflected wave. Reinforcement is possible because the waves have been inverted by a second reflection from the shorted end of the transmission line. The sum of waves injected into the line during the first cycle and the new forward-going wave gives a voltage of $3V_o$ at the input and a current of $I_o$ injected into the input end of the pulse-forming network at $t=4\tau$. As the process continues, a positive current $I_o$ is injected when the reflected wave is positive, reinforcing the standing wave pattern building on the line.

When the desired voltage level has been obtained in the circuit depicted in FIG. 4, the load is applied. Switch 34 is timed to close when switch 26 is toggled to position 2 so that the cavity impedance is fed from pulse-forming network 16. It should be noted that switch 34 does not represent a physical switch; rather, it represents the impedance of discrete electron beams which arrive with appropriate timing to load cavity 12. After one pulse-forming network pulse duration time $\tau$, switch 32 returns to position 1 so that the pulse-forming network current is replenished by current source 30.

In order to generate a square pulse train with a consistent output voltage, the initial closing of switch 34 is delayed by the time required for the pulse-forming network voltage to build to a value equal to the source current times the load resistance. Since this represents an asymptotic value for the load voltage, the resulting wave form has a constant pulse-to-pulse voltage level. The build up time for this process is given by:

$$t(\text{buildup})=\tau^* V_L/(I_O^* Z_n)$$

where $\tau$ is the pulse duration of the pulse-forming network, $V_L$ is the asymptotic load voltage, $I_O$ is the injected current, and $Z_n$ is the impedance of the pulse-forming network. Alternatively, since $I_o$ is equal to the final value of load current:

$$t(\text{buildup})=\tau^* Z_L/Z_n$$

where $Z_L$ is the impedance of the load.

Figure 4B:
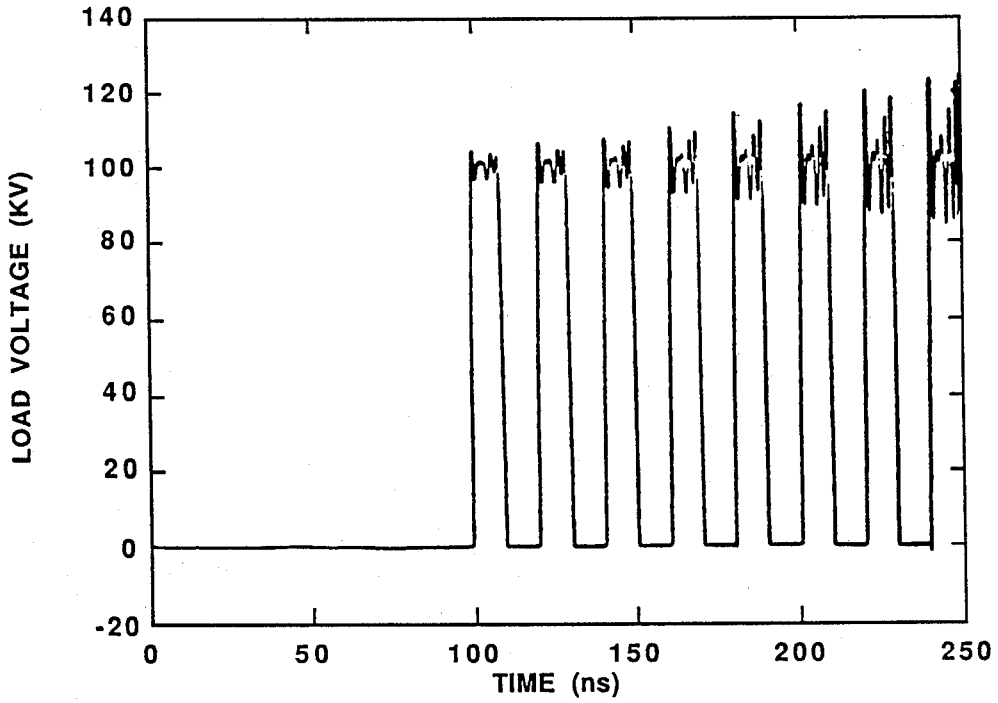

The pulse-forming network voltage and load voltage for the circuit of FIG. 3 are depicted in FIGS. 4A and 4B respectively, for the following case: $Z_n = Z_2 = 10$ ohm; $\tau=10$ ns; $Z_L = 100$ ohm; and $I_O=1$ kA. Therefore, $V_{L\,l} = 100$ kV and $t_{(buildup)} = t_{(delay\ for\ switch\ 34)} = 100$ ns. The initial closing of switch 34 is delayed by 100 ns for the wave form shown in FIGS. 4A and 4B.

The behavior of the circuit in FIG. 3 for the case in which the load is introduced from the beginning of the pulse train is somewhat different. As in the case of FIG. 4A, the load is fed from the pulse-forming network on alternate cycles and the same parameters are assumed. For the first pulse duration, the voltage across the load is given by the source current times the parallel combination of the pulse-forming network and load impedances. As the toggling process continues, the pulse-forming network approaches the source current times the load impedance. At that time, all energy from the current source goes directly into the load. The build-up of the final value of the load voltage is now exponential. The e-folding time for this process is given by the effective capacitance of the pulse-forming network times the load impedance:

$$\tau=(Z_L)\ (C_{pfn}) \text{ where } C_{pfn}=t/Z_n.$$

For this case, $C_{pfn}$ is 1 nf and $\tau$ is 100 ns. Due to the removal of energy during the buildup phase, 100 ns is required to reach 63% of the final load voltage value. In the open-circuit-buildup case of FIG. 4B, this same time period was sufficient to reach the final value.

It is also possible to increase the inductance of the core by adding magnetic material if the desired combination of impedance and pulse duration require a larger inductance than that which can be achieved conventionally with an empty cavity structure.

A linear induction accelerator sharing many of the same concepts of the present invention is discussed in "The PTI Linear Induction Accelerator", R.W. Stinnett et al., 6th IEEE Pulsed Power Conference, Arlington, Virginia, 1987. This paper is herein incorporated by reference.

While the present invention has been described with respect to an exemplary embodiment thereof, it will be understood by those of ordinary skill in the art that variations and modifications can be effected within the scope and spirit of the invention.

We claim:

1. A linear induction accelerator of an electron beam comprising:

a pulse current source consisting of a constant current source;

switch means for alternately switching the output of said current source between either first or second terminals and ground; and at least one bipolar converting means, connected between said first terminal and ground, for converting the pulsed current at said first terminal into a bipolar high-voltage, square wave pulse train having a pulse of a first polarity when said output is connected to said second terminal, and a pulse of a second, opposite, polarity when said output is connected to said first terminal;

a matching impedance connected to said second terminal, the impedance at each of said first and second terminals being equal; and cavity means, connected between said first terminal and ground, for accelerating the electron beam during the pulse of a first polarity and for resetting said cavity during the pulse of a second polarity.

2. A linear induction accelerator as claimed in claim 1 wherein said constant current source includes:

a dc power source;

a low-voltage, microsecond-pulse-duration pulse-forming network connected to said power source; and a high-voltage, pulse-charging step-up transformer through which said low-voltage pulse-forming network is discharged.

3. A linear induction accelerator as claimed in claim 2 wherein said constant current source further includes a closing switch means for switching said low-voltage pulse-forming network into a primary of said transformer.

4. A linear induction accelerator as claimed in claim 3 wherein said pulse converting means is a type A, current-fed Guillemin network.

5. A linear induction accelerator as claimed in claim 4 wherein said Guillemin network includes five sections, each of said sections having a capacitor and an inductor connected in series between said first terminal and ground, and one of said sections having a capacitor and an inductor connected in parallel between said first terminal and ground.

6. A linear induction accelerator as claimed in claim 1 wherein said switch means consists of a high-repetition-rate single pole double-throw switch.

7. A linear induction accelerator as claimed in claim 6 wherein said closed switch is an opposed pair of photoconductive semiconductor switches.

8. A linear induction accelerator as claimed in claim 1 wherein said cavity means comprises at least one toroidal accelerating cavity for each bipolar converting means, each cavity being connected in series, whereby the electron beam may be accelerated by each cavity.

9. A linear induction accelerator as claimed in claim 8 wherein each accelerating cavity defines an evacuated volume.

10. A linear induction accelerator as claimed in claim 8, wherein each accelerating cavity contains a ferrite core.

* * * * *